United States Patent [19]

Greis et al.

[11] Patent Number: 4,571,972

[45] Date of Patent: Feb. 25, 1986

[54] SKEWED-AXIS CYLINDRICAL DIE ROLLING

[75] Inventors: Howard A. Greis, Holden; Charles A. Garniewicz, Worcester, both of Mass.

[73] Assignee: Kinefac Corp., Worcester, Mass.

[21] Appl. No.: 584,160

[22] Filed: Feb. 27, 1984

[51] Int. Cl.[4] ..... B21H 3/04

[52] U.S. Cl. ..... 72/98; 72/104

[58] Field of Search ..... 72/98, 103, 104; 411/417; 308/205

[56] References Cited

U.S. PATENT DOCUMENTS 3,602,027 8/1971 Klug et al. ..... 72/98

3,626,733 12/1971 Zook et al. ..... 72/104

FOREIGN PATENT DOCUMENTS 2233115 1/1975 France ..... 72/104

*Primary Examiner*—Lowell A. Larson

*Attorney, Agent, or Firm*—Charles R. Fay

[57] ABSTRACT

Skewed-axis cylindrical-die rolling method for the production of combined screw-thread and gear-tooth forms on the external surface of bars using multi-element dies which progressively form the screw thread and then the gear teeth on a portion of the screw thread in which the gear-tooth forming die element is free-rotating and the other die elements are driven.

8 Claims, 11 Drawing Figures

FIG. 4B
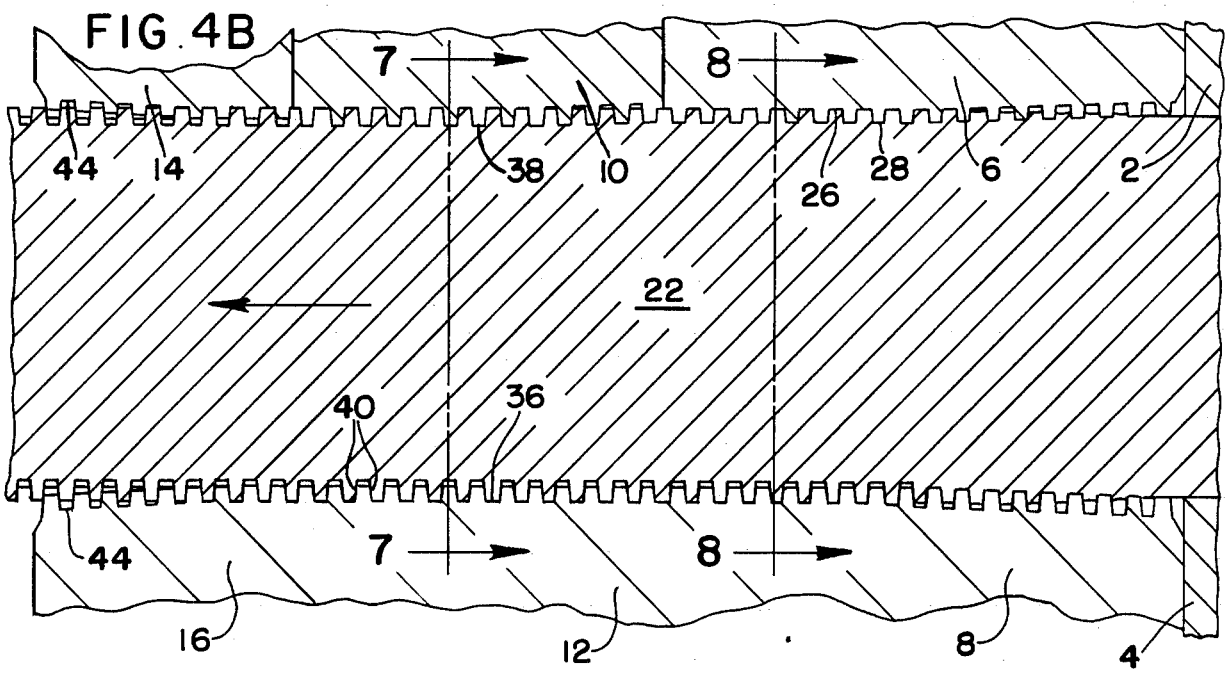
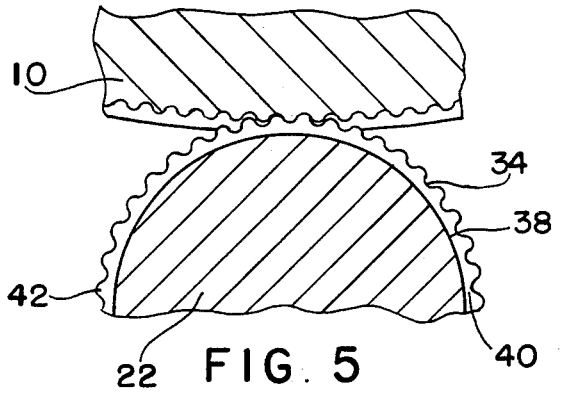
FIG. 5
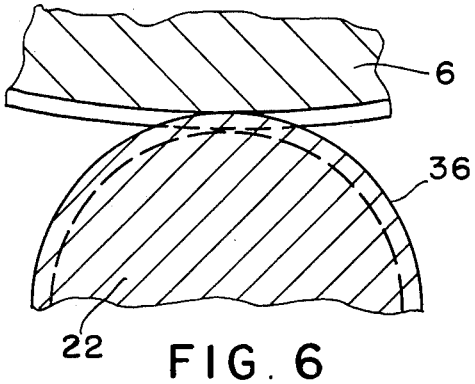
FIG. 6
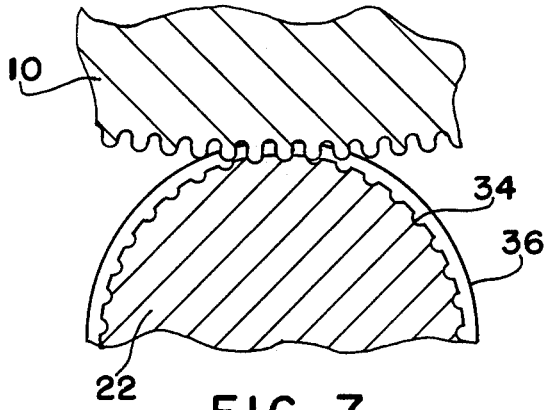
FIG. 7
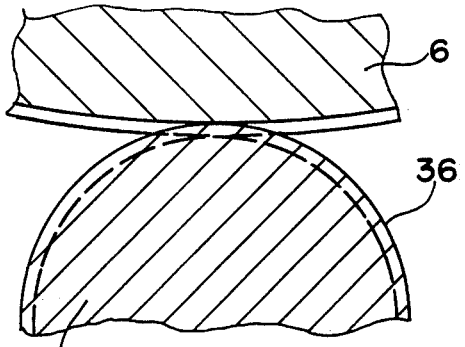
FIG. 8

FIG. 9
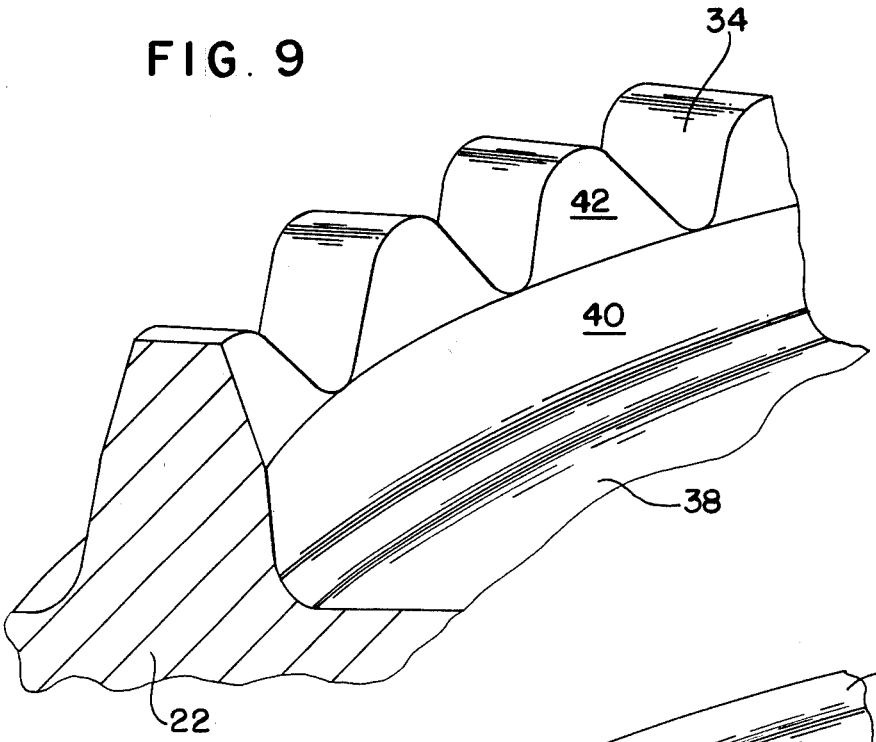
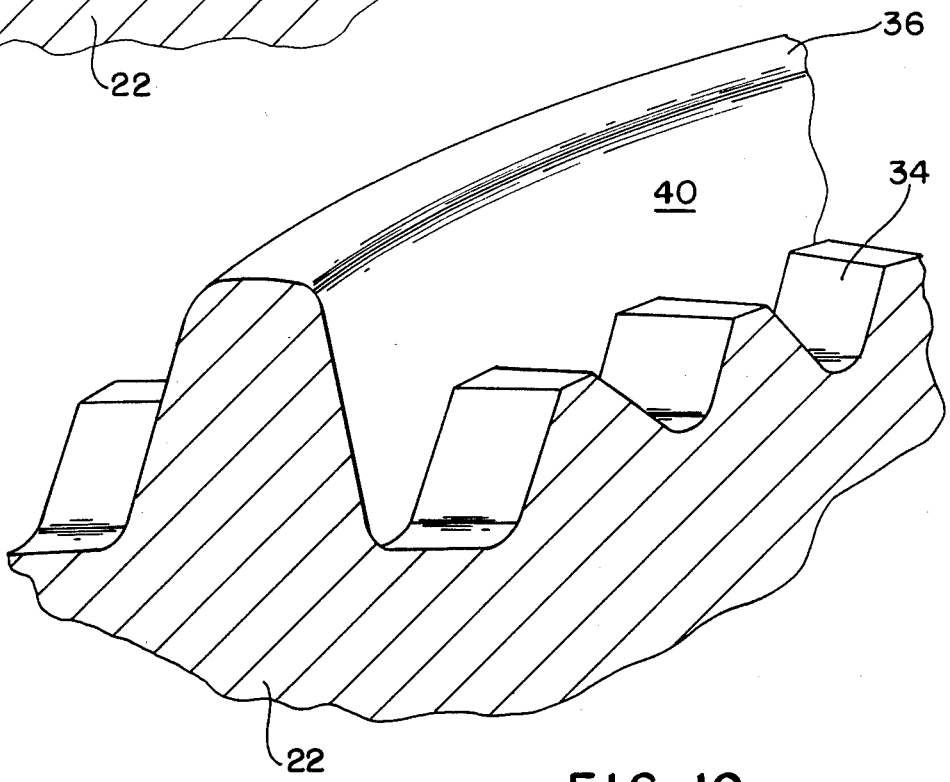
FIG. 10

SKEWED-AXIS CYLINDRICAL DIE ROLLING

FIELD OF THE INVENTION

Skewed-axis cylindrical-die rolling for the production of combined screw thread and gear tooth forms on the external surface of bars.

BACKGROUND OF THE INVENTION

The recent development of high mechanical advantage actuator screw systems, in which the nut consists of a series of helical rollers surrounding the jack screw, created the need for a means to cause those rollers to rotate in phased relationship with the jack screw. The best means of doing this appeared to be the addition of a gear tooth form in the root of the screw and a mating gear tooth form on the crest of the rollers.

Initially, prototypes of such screws and rollers were produced by various multiple-pass metal cutting techniques which succeeded in proving the practicality of actuators in which the actuator screw was geared to rollers in the nut by gear tooth forms which were integral with the screw and rollers. However, such manufacturing methods required multi-pass metal cutting techniques in which the screw thread was initially cut and the gear tooth form was subsequently cut or deformed into the screw thread. Such techniques also involved difficult deburring processes after the gear teeth were cut in the second pass.

The complexity of the manufacturing operations made the cost of such actuators high and limited their marketability.

This invention is a new means of skewed-axis roll forming these combined screw thread and gear tooth form parts which has many advantages. It requires only one forming pass and that is performed in a standard cylindrical die rolling machine of the two-die or three-die type. It is high speed, allowing the combined thread/tooth forms to be produced at rates as fast as 300 inches per minutes. It is chipless, and therefore reduces material costs. Finally, because of the character of the forming operations, the parts require no deburring after the initial forming operation. In some cases it may be necessary to centerless grind the O.D. of whichever part has the involute in its root so as to produce the desired radial fit between the screw and the roller. However, this is also a high-speed operation, and, as a result, the use of this invention creates great cost savings and therefore significantly expands the market for this type of actuator.

SUMMARY OF THE INVENTION

In this invention for the single-pass roll forming of a continuous combined screw thread and gear tooth forms on a bar using a two- or three-cylindrical-die rolling machine, a cylindrical blank of a predetermined diameter is introduced into a system of dies which progressively rotate the bar, gradually roll form the screw thread, roll form the gear teeth either on the root or crest of the screw thread form, constrain the edges of the gear teeth in such a way that the workpiece requires no subsequent deburring, and finally continue the rotation of the completed workpiece until it exits the dies.

The initial die elements on all spindles are smooth so as to center the blank, and to take out the spring in the spindle support system of the rolling machine. They also provide initial rotation of the cylindrical blank. The next die elements on all spindles are of the thread rolling type which progressively roll form the screw thread on the bar, as well as to preform the blank area onto which the gear tooth form will then be rolled. These dies are all driven in rotationally phased relationship with one another, are skewed to provide for the through feeding of the bar, and are axially spaced to correctly engage with the helix being formed.

In the next stage, a free-rotating gear-tooth forming die progressively forms the gear tooth form on the root or crest of the screw form. This axially toothed forming die is opposed in the two-die configuration by a single driven annular supporting die which acts upon the flanks and root or crest of the screw thread form, depending on whether the gear tooth is being roll-formed on the root or crest. In a three-die configuration there are two such supporting dies. It should be noted that in some cases it is possible to use free-rotating gear tooth die element on all of the spindles in this step. The final stage of the die system provides continuing drive and support for the finished screw as it leaves the dies, and at the same time, where the involute is being formed on the crest of the screw, limits the axial flow of the gear-tooth roll-forming action and thereby creates gear teeth that do not require deburring.

When the three-die configuration is used, no work support blade is required. In the two-die configuration, a work support blade is required to maintain the centerline of the bar being rolled slightly below the line of centers between the two opposing forming die systems. This blade is relieved to follow the forming action as it develops.

This method can be used to provide multiple as well as single lead screw thread forms with gear teeth on the root or crest, and the gear teeth may be either straight or helical in relation to the axis of the screw.

BRIEF DESCRIPTION OF THE DRAWINGS

FIG. 4-B is an enlarged longitudinal sectional view of the invention in FIG. 1 and FIG. 2 taken along line 4—4 in which gear teeth are being formed on the root of the screw thread form.

FIG. 5 is an enlarged sectional view taken along line 5—5 of FIG. 4-A showing the relationship between the work-in-process and the dies.

FIG. 6 is an enlarged sectional view taken along line 6—6 of FIG. 4-A showing the relationship between the work in process and the dies.

FIG. 7 is an enlarged sectional view taken along line 7—7 of FIG. 4-B showing relationship between the work in process and the dies.

FIG. 8 is an enlarged sectional veiw taken along line 8—8 of FIG. 4-B showing relationship between the work in process and the dies.

FIG. 9 is an enlarged sectional perspective view of a screw thread with gear teeth on the crest.

FIG. 10 is an enlarged sectional perspective view of a screw thread with gear teeth in the root.

PREFERRED EMBODIMENT OF THE INVENTION

Figure 1:
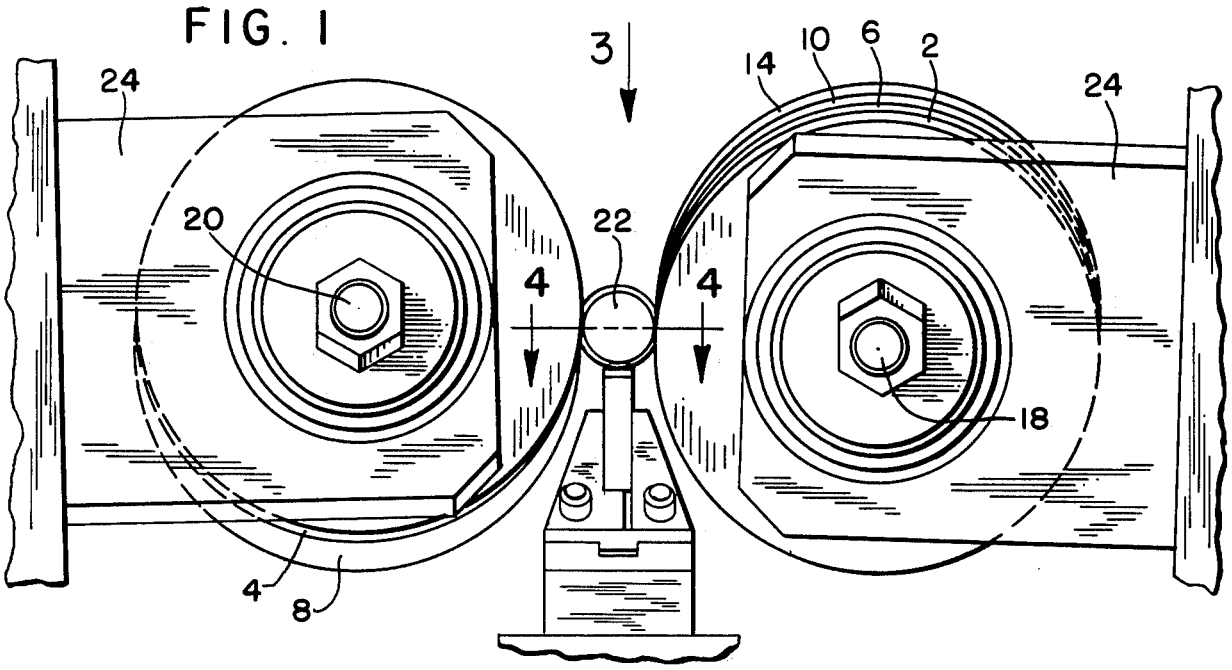
FIG. 1 is a front view of the invention in a skewed-axis two-die rolling machine.
Figure 2:
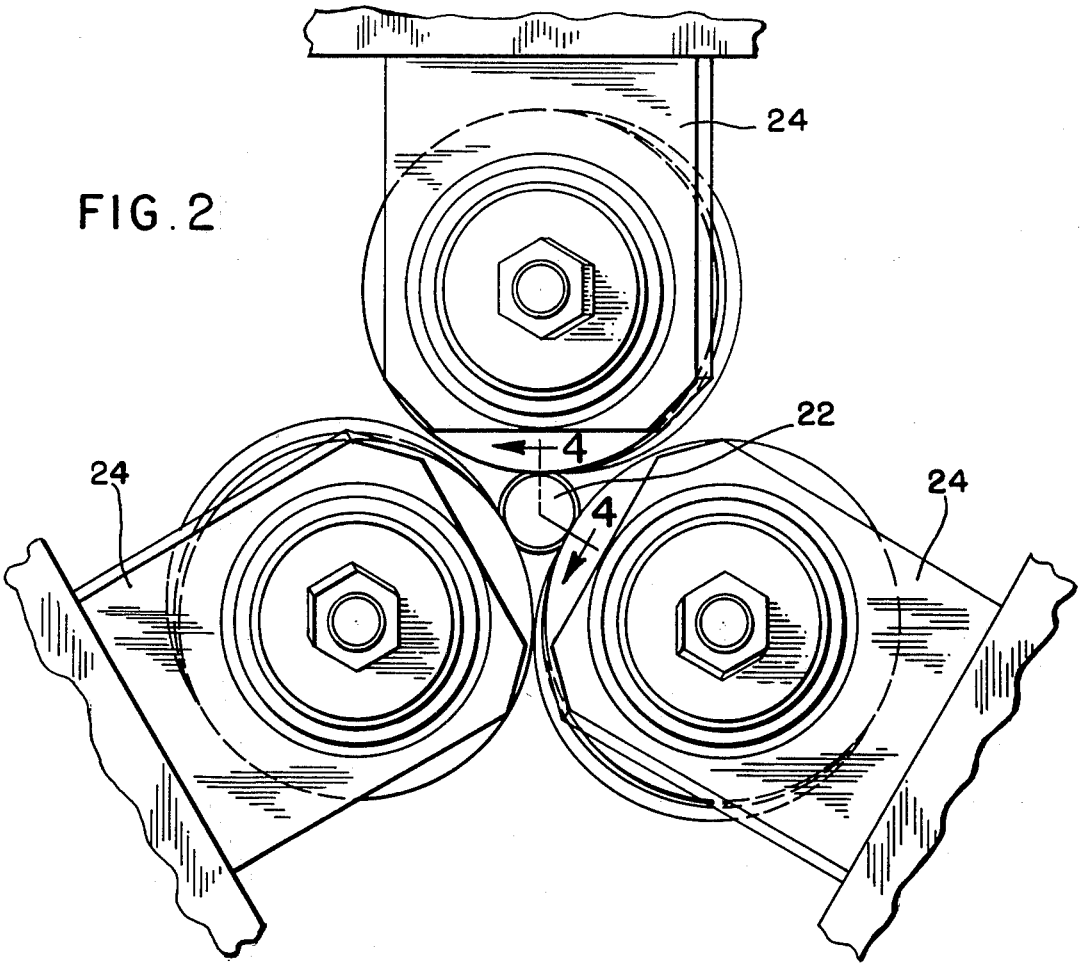
FIG. 2 is a front view of the invention in a skewed-axis three-die rolling machine.
Figure 3:
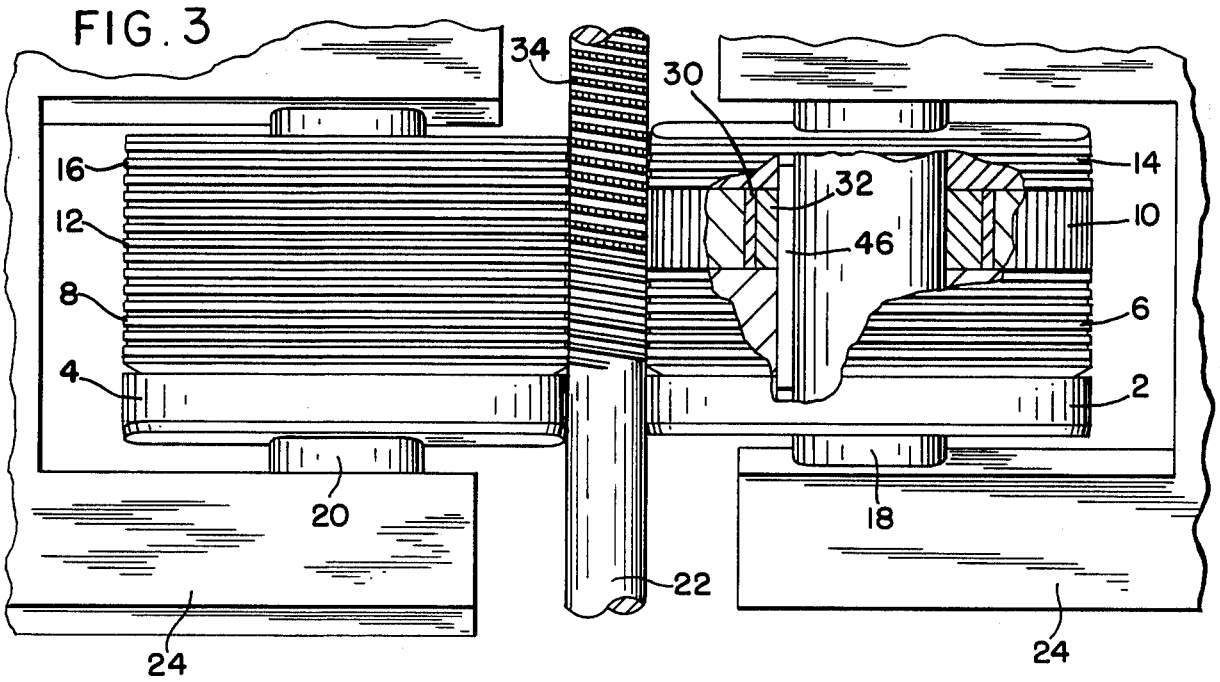
FIG. 3 is a top plan view of the invention with a partial sectional view of internal detail taken in the direction of arrow 3 in FIG. 1 and FIG. 2
Figure 4A:
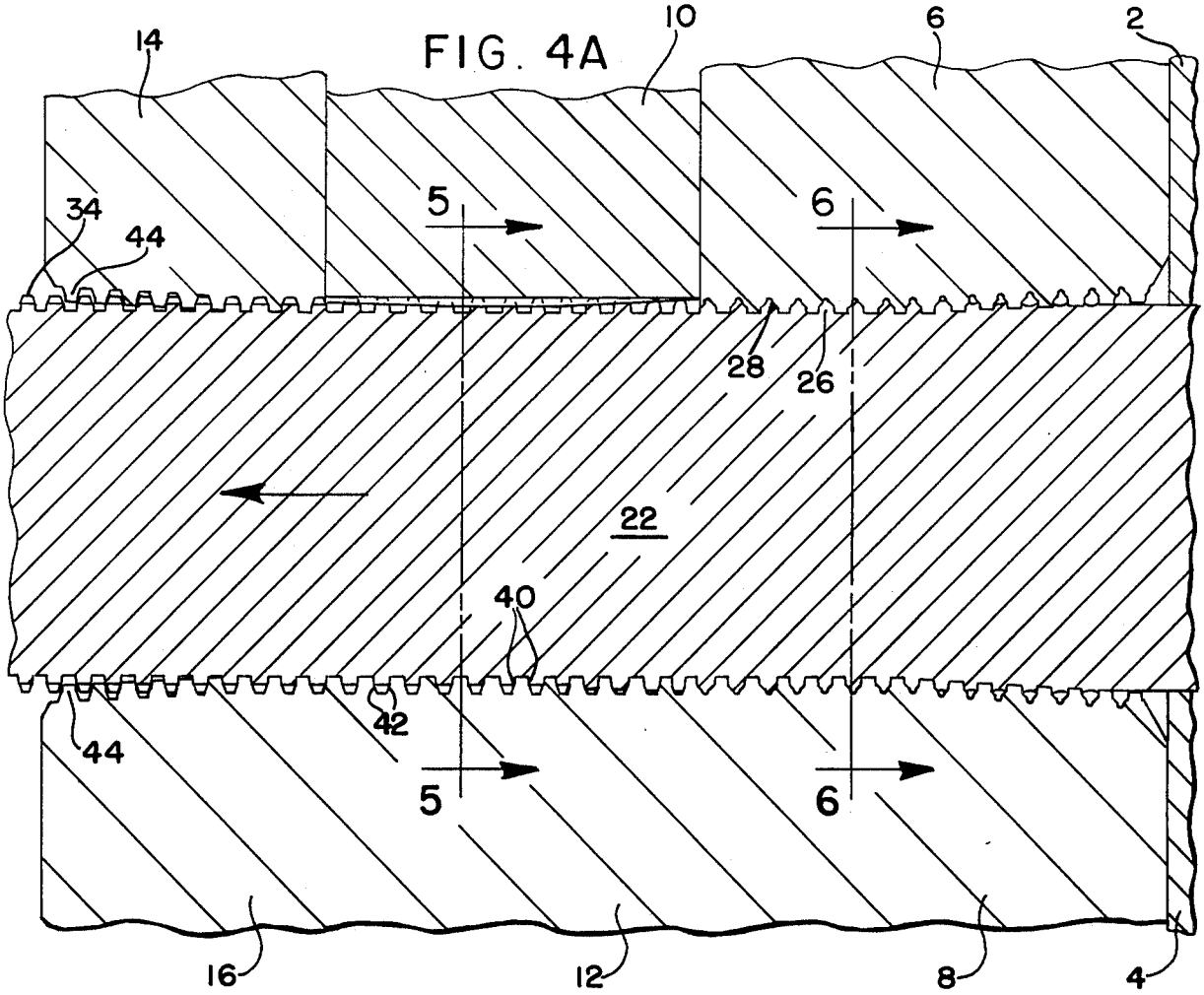
FIG. 4-A is an enlarged longitudinal sectional view of the invention taken along line 4—4 in FIG. 1 and FIG. 2 in which gear teeth are being formed on the crest of the screw thread form.

The preferred embodiment of this invention comprises a system of cylindrical rolling dies 2, 4, 6, 8, 10, 12, 14 and 16 mounted on the spindles 18 and 20 of a conventional skewed-axis cylindrical-die rolling machine operating on a workpiece 22 at an angle approximately equal to the lead angle of the thread form being rolled.

The spindles are held by a typical spindle support system of a two- or three-cylindrical-die rolling system. The spindles are driven in rotationally phased relationship with each other and are skewed with respect to the workpiece axis of rotation.

The workpiece of a predetermined diameter with the correct volume of material to produce the desired screw thread and gear tooth form is inserted axially into the entering and prerotating die elements 2, 4 which are keyed 46 to the spindles 18 and 20.

These die elements have a tapered entry section which forces them apart to take the spring out of the rolling machine spindle support system 24. At the same time, they bring the workpiece 22 up to correct rotating speed. As the workpiece moves axially forward, it enters the space between the annular thread roll forming die elements 6, 8 which progressively form the thread form on the workpiece and at the same time provide the rotational drive necessary for the workpiece to continue to pass through subsequent die elements.

After the screw thread form 26 has been fully formed, and the gear tooth blank area 28 shaped and sized, the workpiece 22 next moves between the free-rotating gear-tooth rolling die element 10 and the thread supporting die elements 12 which are keyed to the spindle 20. Because the rolling radius of the gear tooth form rolling die element 10 is slightly different than the rolling radius of the thread forming die elements 6, 8, it is free to rotate on and supported by a cylindrical bearing 30 which is mounted on the journal 32 which is keyed to the spindle 18.

This freedom of rotation allows the gear teeth of the gear tooth rolling die element 10 to step off with an integer number of teeth at the correct circular pitch on the gear-tooth rolling blank area 28. It thus progressively forms the gear teeth 34 on the crest or root of the thread. To support the gear-tooth forming force, the thread supporting die elements 12 contact the thread form in the area where the gear tooth form is not being rolled. When the gear tooth form 34 is being rolled on the screw thread crests 36, then the supporting die element contacts the screw thread roots 38. When the gear tooth form 34 is being rolled on the screw thread roots 38, the supporting die element contacts the screw thread crests 36. In both of these cases, the supporting contact continues onto the adjacent screw thread flanks 40 to prevent deformation of the screw thread due to the supporting force.

In addition, when the gear teeth 34 are rolled on the crest of the screw thread 36, the flank contact is continued outward to the gear tooth flanks 42. Then, as the gear teeth 34 are being progressively formed, that material which tends to flow axially is pushed back into the gear tooth area, thereby preventing burr buildup on the edges of the rolled gear teeth.

As the workpiece 22 moves out of the gear tooth forming area, it moves between the finishing support and rotating die elements 14 and 16 which also engage the screw thread form in the areas that do not have gear teeth. These die elements are keyed to the spindle 18, 20 so they continue to drive the workpiece 22 rotationally as its trailing end passes through the free rotating gear tooth rolling die element 10. The exit portion of these support and rotating die elements has a finished relief 44 which drops away allowing the rolled workpiece to gradually depart from the die system without marking it.

As can be seen by those skilled in the rolling art, there may be numerous minor variations made to the disclosed method without departing from the basic concept of the invention. Furthermore, although the method of the invention as shown is applied to combined screw, thread, and gear tooth forms, it should be recognized that it is equally capable of producing other specialized forms which combine a low lead-angle helical form of differing rolling diameter radius.

We claim:

1. Method of making die roll formed screw threads having gear teeth on certain like areas thereof in a single pass of a workpiece through a multi-element die system comprising:

(1) Die rolling screw threads on the workpiece during rotation and support of the workpiece and performing certain areas thereof to receive the gear teeth, (2) Die rolling gear teeth on said areas, wherein the gear teeth are formed at the crest of the screw thread, (3) The edges of the gear teeth being roll formed being constrained by a support die to prevent the development of axial burrs.

2. Method of claim 1 wherein the threads and teeth are formed substantially simultaneously.

3. Die roll for forming helical thread-like forms having teeth on like portions thereof on a workpiece, comprising at least two die rolls in cooperative relation, said die rolls being multi-element, means supporting and driving the workpiece, one driven element forming helical threadlike forms preformed in certain areas to receive die-rolled teeth, and another element forming the teeth immediately subsequent to the formation of the helical threadlike forms, wherein the last named element is constructed to form the teeth at the crest of the threadlike form, a subsequent part of the die roll including means for reforming the sides of the teeth.

4. Method die roll formed helical forms having precisely formed teeth on certain like areas thereof in a single pass of a workpiece through a multi-element die system comprising:

(1) Die rolling helical forms having crests on the workpiece while rotating and supporting the workpiece and preforming the crests to receive the teeth;

(2) Die rolling teeth on said crests while continuing rotating and supporting the workpiece during the rolling of the teeth;

(3) The supporting function being applied only to the non-tooth portion of the rolled form;

(4) And preventing the development of burrs by constraining the edges of the teeth being roll formed and in part reforming the same by a supporting die.

5. Die roll for forming on a workpiece helical forms having teeth on the crests thereof, comprising at least two die rolls in cooperative relation, means rotating and supporting the workpiece, (1) one driven die roll forming helical forms preformed at the crests of the helical forms to receive die rolled teeth;

(2) a free-running second die roll forming the teeth immediately subsequent to the formation of the helical forms with the workpiece rotating and supported;

(3) and means for reforming the side aspects of the teeth.

6. Method of die rolling forming two forms of different rolling radius wherein one form is helical and the other form comprises precision teeth, on a common workpiece in a single pass through a multi-element die system, driving a die roll forming the helical forms while providing for the free rolling of a die roll forming the teeth, the die roll forming the helical forms providing the helical forms with roots and crests, and being located to operate on the workpiece at a point thereon separate from that of the tooth forming die roll, and supporting the workpiece at an area removed from the area of the tooth forming so that the supporting function fails to coincide with the tooth forming function.

7. The method of claim 6 wherein the second-named die elements form the gear teeth on the roots of the screw.

8. The method of claim 6 wherein the second-named die elements form the gear teeth on the crests of the screw.

* * * * *